United States Patent [19]

Schelb

[11] Patent Number: 4,483,820

[45] Date of Patent: Nov. 20, 1984

[54] METHOD OF MAKING SINTERED POWDER METALLURGICAL BODIES

[75] Inventor: Bernhard Schelb, Remscheid, Fed. Rep. of Germany

[73] Assignee: Sintermetallwerk Krebsöge GmbH, Radevormwald, Fed. Rep. of Germany

[21] Appl. No.: 230,103

[22] Filed: Jan. 29, 1981

[30] Foreign Application Priority Data

Feb. 6, 1980 [DE] Fed. Rep. of Germany ..... 3004209

[51] Int. Cl.[3] ..... B22F 1/00; B22F 3/00

[52] U.S. Cl. ..... 419/28; 164/15; 164/16; 419/36; 419/37; 419/38; 419/53

[58] Field of Search ..... 75/211; 419/28, 36, 419/37, 38, 53; 264/121; 164/15, 16, 529

[56] References Cited

U.S. PATENT DOCUMENTS

| | | | |
|---|---|---|---|
| 2,386,544 | 10/1945 | Crowley | 419/36 |
| 2,709,651 | 5/1955 | Gurnick et al. | 419/36 |
| 2,792,604 | 5/1957 | Bartlett et al. | 164/529 |
| 2,928,733 | 3/1960 | Wagner | 419/36 |
| 3,409,579 | 11/1968 | Robins | 164/16 |
| 3,587,709 | 6/1971 | Miller et al. | 164/16 |
| 3,811,878 | 5/1974 | Chao et al. | 75/211 |
| 3,888,663 | 6/1975 | Reichman | 419/28 |
| 3,989,518 | 11/1976 | Rueckl | 419/36 |
| 3,992,200 | 11/1976 | Chandhok | 75/211 |
| 3,997,341 | 12/1976 | Janowski et al. | 419/53 |
| 4,063,940 | 12/1977 | Dain et al. | 419/38 |
| 4,150,704 | 4/1979 | Hoult | 164/529 |
| 4,209,326 | 6/1980 | Klein et al. | 75/211 |
| 4,268,425 | 5/1981 | Gardikes | 164/16 |

FOREIGN PATENT DOCUMENTS

| | | | |
|---|---|---|---|
| 1964426 | 8/1973 | Fed. Rep. of Germany . | |
| 1294159 | 4/1962 | France | 164/529 |
| 61429 | 5/1976 | Japan | 164/529 |
| 122630 | 9/1979 | Japan | 164/529 |
| 1219379 | 1/1971 | United Kingdom | 164/529 |

OTHER PUBLICATIONS

*International Journal of Powder Metallurgy and Powder Technology*, 1975, vol. 11, No. 3, pp. 209–220.

*Primary Examiner*—John Doll
*Assistant Examiner*—Wayne A. Langel
*Attorney, Agent, or Firm*—Karl F. Ross; Herbert Dubno

[57] ABSTRACT

A process for making sintered metal articles of high strength in which a flowable mass of metallic particles is initially formed into a green compact having shape stability in a forming machine of the type used in the fabrication of sand cores in the metal casting field. The green compact is then subjected to sintering and the sintered body may be pressed, forged or mechanically shaped in other ways. The core blowing or core-sand slinging machine used to produce the green metal compact is surprisingly effective in producing a dense, reproducible structure in light of the fact that sand cores for casting purposes are intentionally made frangible to enable them to be removed effectively from the casting.

8 Claims, 1 Drawing Figure

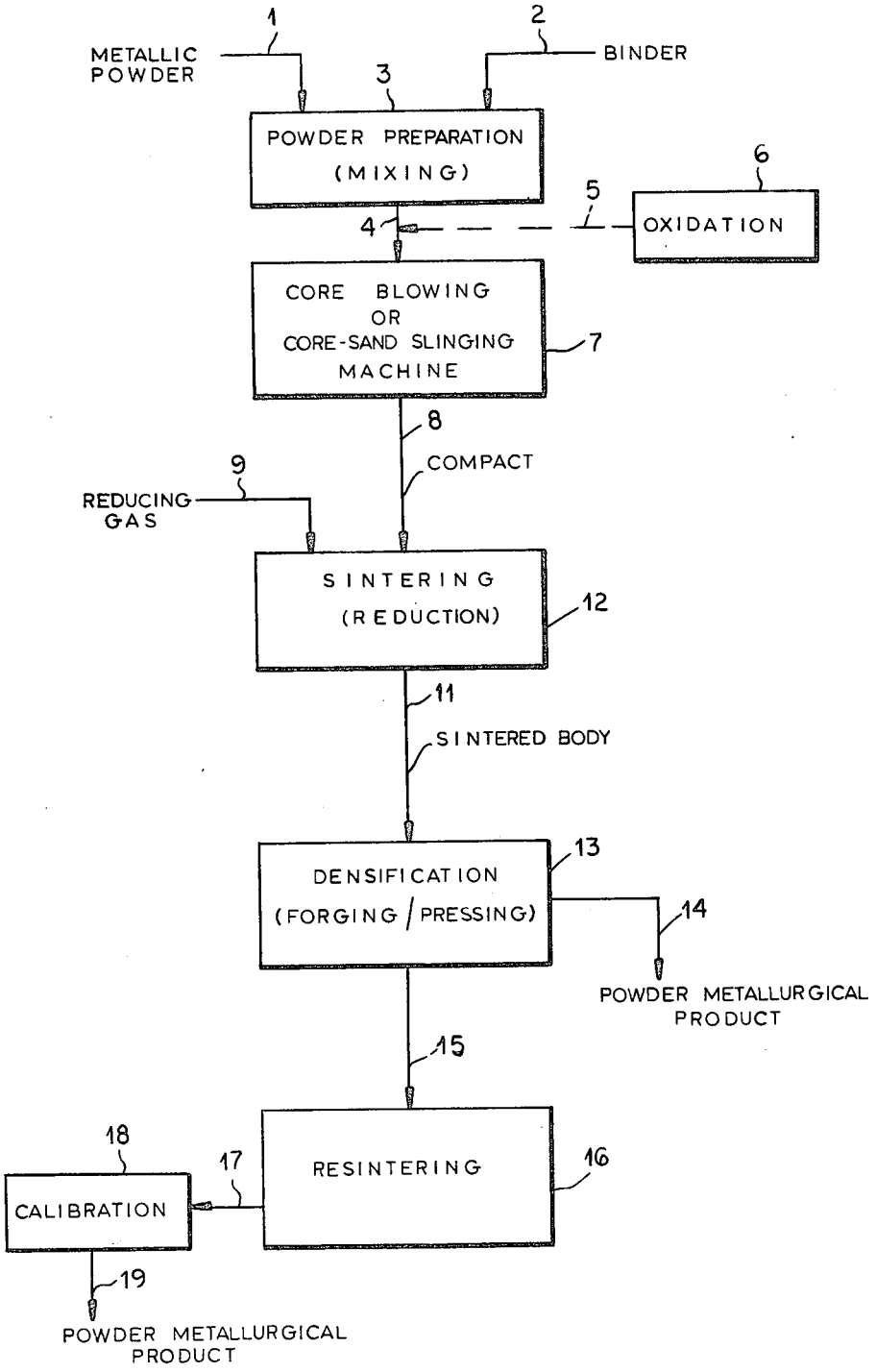
1
METALLIC POWDER
2
BINDER
3
POWDER PREPARATION (MIXING)
6
5
OXIDATION
4
CORE BLOWING OR CORE-SAND SLINGING MACHINE
7
8
COMPACT
9
REDUCING GAS
SINTERING (REDUCTION)
12
11
SINTERED BODY
13
DENSIFICATION (FORGING / PRESSING)
14
POWDER METALLURGICAL PRODUCT
15
18
17
RESINTERING
16
CALIBRATION
19
POWDER METALLURGICAL PRODUCT

METHOD OF MAKING SINTERED POWDER METALLURGICAL BODIES

FIELD OF THE INVENTION

My present invention relates to the field of powder metallurgy and, more particularly, to the fabrication of high strength metal bodies from metallic powders. The invention is thus directed to a method of fabricating such powder metallurgical structures and to a method of operating equipment for this purpose.

BACKGROUND OF THE INVENTION

In the fabrication of many metallic articles for modern technology, it has been found to be advantageous to utilize powder metallurgy, either because the metals which are used cannot conveniently be shaped by earlier conventional machining techniques, or because the shapes are such that the earlier casting and machining technology is ineffective. In addition, it is possible by powder metallurgical techniques to produce bodies which can have some degree of porosity, an advantage when fluids may be taken up or dispensed by the body, or where the finished article should have a lesser density than that of the solid elemental metal or alloy.

Powder metallurgical techniques also may be used to advantage when the composition of the body is such that an equivalent composition cannot be made by casting or the like.

In general, the powder metallurgical approach requires the shaping of a mass of metallic powder and the subsequent or contemporaneous stabilization of the shaped mass so that the desired strength and shape retentivity can be achieved.

In the usual approach, a finely divided metal powder in a flowable form is poured into a cavity having the shape of the desired body and is compacted, compressed or otherwise densified in this mold to produced a so-called green compact.

The green compact is then sintered to produce a structurally stable body which may be used as such or which can be formed, densified, shaped or altered as to its physical and/or chemical properties to yield the ultimate object. Typical of the processes to which the sintered body can be subjected are various pressing and forging techniques which alter the grain size and strengthen the body.

The sintering step requires fusion of the mutually contacting metal particles of the green compact so that the particles partially merge with one another at their contact points or surfaces, the sintering temperature being below the melting point at which the particles are converted into a liquid phase.

Subsequent to or during sintering, the body can be densified by the application of pressure.

The sintered body is generally porous and can be used as such if it has sufficient strength, or can be subjected to the further densification or strengthening steps mentioned, these steps generally involving a reduction in the porosity of the body.

The further compaction after sintering can be effected in the cold state of the body or in a warm or hot condition thereof and it is also possible within the context of conventional powder metallurgy, to subject a previously sintered and densified body to a further sintering step at an elevated temperature to cause even further coalescence of the particles at their interfaces or modification of the grain structure.

The starting powder can be free from a binder or can be combined with a binder.

Naturally, the term "green" is here used in the sense in which this term has been employed in the powder metallurgical field heretofore, not to refer to an object having a green coloration, but rather to refer to the coherent compact in its presintered state as one in which there has been no significant coalescence of the mutually contacting surfaces.

As described in the *International Journal of Powder Metallurgy and Powder Technology,* 1975, Vol. 11, No. 3, Pages 209 to 220, the metal powder can be combined with an organic binder which, in this publication, is preferably saccharose. The binder-containing metal-powder mass can be densified in a mold of the shape of the article to be made by simple vibration.

The resulting green compact is found to have insufficient green strength to enable it to be removed from the mold and to be manipulated as desired. Hence at least partial sintering is effected while the green compact is within the mold.

The sintering of green compacts within the mold so that they can ultimately be withdrawn and handled, has significant disadvantages. Experience has shown, for example, that such sintered bodies do not have sufficiently homogenous and reproducible physical parameters such as density, strength and porosity or pore volume.

The porosity, density and strength are also adversely affected by the use of reduced metal powders which tend to interfere with sintering. The physical parameters are thus a function of the degree of sintering which can vary from body to body even where essentially identical process conditions are maintained.

In fact, these parameters can vary markedly from place to place even within a given body, especially if, in the formation of the green compact, the compacting has not been uniform.

The same applies for carbonization parameters when a carbonization is carried out in addition to the sintering. This is particularly the case when the powder metallurgical operations are carried out in the absence of binders or with small quantities of binder or the sintered body ultimately has a plurality of different cross sections.

In a preferred mode of producing sintered metal bodies, a reduced metal powder with the lowest possible oxygen content is generally employed although such metal powders are comparatively expensive. Such powders are shaped by prepressing with elevated press pressures into the green compact and sintered to produce a body which can be subsequently treated, shaped or handled.

It will thus be appreciated that earlier techniques in the fabrication by powder metallurgy of sintered metal bodies have generally involved a tradeoff whereby more expensive metal powders were required or the processing technology was more complex.

In a field remote from powder metallurgy, namely in the production of sand molds for molten metal casting, it is known to produce a mold cavity from mold sand and foundry sand binders. Such molds can be provided with so-called sand cores which also generally comprise foundry sand and binders designed to provide the core which is used to form an internal cavity hole or recess in the casting, so that the core possesses a certain degree of integrity during the casting operation but yet, as a result of the heating during the casting process, loses this integrity in whole or in part and becomes frangible or otherwise easily removable from the hole, recess or cavity once the casting is removed from the mold.

Such cores, while having sufficient green strength to resist the pressure of the molten metal during the casting operation, lose integrity upon heating during the casting process. This is also the case with more recently developed foundry sand binders of a synthetic resin base.

Sand cores of the aforedescribed type can be produced, as is well known in the foundry field, on core forming machines which have mechanized the production of such cores for foundry purposes.

Heretofore such machines have been used exclusively for the production of bodies, namely the sand cores, which intentionally have diminshed integrity and strength upon being subjected to elevated temperatures, e.g. during casting. Such machines have not, to my knowledge, ever been used in the fabrication of any bodies other than sand cores for foundry purposes and certainly have not found application in the powder metallurgical field which, by contrast with foundry applications of sand cores, requires that a heated body gain in strength as a result of the heating operation, e.g. sintering.

In fact, the production of sand cores for foundry purposes and powder metallurgical technologies are vastly different and have little if any common basis, dealing with different problems and different approaches to the solutions thereof. The field of metal shaping has long recognized a severe dichotomy between workers with the powder metallurgical approach and with foundry expertise.

From German patent documents - Printed Application DE AS 1964 426, it is known to provide sintered metal bodies using the metallic powder in combination with an organic powder in the form of a hardenable resin, generally of the epoxy type, the mixture of the powder and the resin forming a flowable mass which is poured into a cavity to produce a body analogous to a green compact which is then hardened in this cavity.

The shaped compact can then be subjected to a multistage heat treatment, the first stage of which involves the composition of the binder, while further stages result in sintering of the metal particles of the body together.

In this approach as with the other powder metallurgical techniques described the homogeneity or isotropy of the physical phenomena in the sintered body is not sufficient, i.e. the uniformity throughout the body leaves much to be desired and the process may not be reproducible in the fabrication in a number of such bodies which should be identical as to these physical properties.

Apparently the homogeneity and reproduceability deviates from desired levels as a result of the nonuniformity in the distribution of the metal powder in the flowable binder which, in turn, may be affected by the way in which the flowable mass is poured into the cavity or the conditions under which such pouring takes place.

In general, as to conventional powder metallurgical techniques known heretofore, a major problem has resided in the inability to produce articles of an extremely high level of homogeneity in a fully reproducible and economical manner especially when the bodies to be formed have different cross sections.

OBJECTS OF THE INVENTION

It is the principal object of my present invention to provide an improved method of making sintered metal bodies whereby the disadvantages of the earlier techniques in the powder metallurgical art can be obviated.

Another object of the invention is to provide an improved method of making metal bodies of a high degree of homogeneity in a reproducible and economical manner, even in the case of bodies having portions of different cross section.

Yet another object is to provide an improved powder metallurgical process which can be used to form intricate metal bodies in a simple and convenient manner.

Another object is the providing of an improved method of operating a machine which enables sintered metal bodies to be made with practically homogenous physical parameters even when such bodies have differing cross sections.

SUMMARY OF THE INVENTION

These objects and others which will become apparent hereinafter are attained, in accordance with the present invention, by a method wherein a particulate mass of a metallic material is shaped into a green compact by the kinetic displacement of the metal particles into a shaping form, the resulting compact being removed from this form and then being subjected to a sintering operation. I have found that by introducing with comparatively high kinetic energy the particulate metallic mass into a shaping form, it is possible to produce a homogeneously compacted green body which has sufficient strength to enable it to be handled, removed from the form and subjected externally of the form to sintering.

More particularly, this invention provides that the flowable metallic particle mass is shaped into the green compact in a conventional core-forming machine which, in spite of its designation, is here used not to make casting cores but rather to produce green compacts to have sufficient green strength to enable them to be removed from the forming cavity and to be subjected to sintering.

Surprisingly while such machines have been used in the past in the foundry industry to make cores of intentionally limited integrity, the same machines can be utilized with powder metallurgical materials to produce bodies which ultimately are of high strength and density and which can be subjected after sintering, if desired, to additional processing, e.g. by forging to increase strength, change the shape or alter grain-crystalline parameters.

According to a feature of the invention, metallic-powder mass can include a binder although binder-free operation is also possible. In a preferred embodiment of the invention, the metallic powder is mixed with a synthetic resin binder that forms the flowable mixture which is shaped into the green compact on a core-forming machine while a variety of synthetic resin binders can be used, it is only essential that these binders be compositions which are effective for powder metallurgical purposes, e.g. decompose upon sintering, allow the mixture to be pourable and enable the mixture to be handled in a forming machine of the core-forming machine type.

The organic binder, surprisingly, need not be exclusively of a type heretofore developed for the powder metallurgical art but can be a conventional foundry sand binder of the synthetic resin type and further the proportions of the metallic powder on the binder can correspond to the proportion of sand and binder used in the production of foundry cores on such machines.

Advantageously, the organic binder is a phenolic resin binder which can be used in an amount of less than 10% by weight of the mixture, preferably in an amount of about 1% by weight. The foundry sand binders of the synthetic resin type can be used in spite of the fact that, upon heating, they lose their binder capabilities and permit collapse of sand cores, because the shaped compacts of the present invention are heated to sintering temperatures and thus retain their strength and integrity.

It is possble, using a machine of the core-forming type, to fabricate green powder metallurgical compacts of complicated shapes and zones of markedly different cross sections with a uniform density and degree of compaction completely without segregation phenomena, i.e. phenomena whereby the metal powder is separated from the synthetic resin binder and vice versa. As a result the sintered body and the ultimate shaped member have completely homogenous physical parameters.

Surprisingly, the green compact in accordance with the invention has an unusually high green strength so that it can be handled free from the shaping form and sintered also without retention in the form and thereby also reduced, carburized or decarburized.

For compaction of the sintered body I can make use of hot or cold compression techniques which are themselves conventional in the metallurgical arts for the production of sintered bodies and other objects. An important advantage of the invention is that objects can be made by the present process which could not be fabricated as sintered bodies or by powder metallurgical techniques heretofore or could only be fabricated by other techniques at high cost.

The method of the present invention can utilize any conventional metal powder as the starting material for the production of sintered bodies. In general the method can also use mixtures of different metal powders or metallic powders, i.e. powders containing a high proportion of metal but which may also contain metal oxides or the like.

Instead of being restricted exclusively to reduced metal powders which are of high cost and are characterized by their freedom from oxide films or the like, unreduced metal powders or mixtures of reduced and unreduced metal powders can be used.

When the metal powder used as the starting material is unreduced metal powder or contains a quantity of unreduced metal powder, the green compact is preferably sintered in a reducing atmosphere and the reduction is customarily carried out to reduce all of the oxide present or all of the oxide accessible to the reducing atmosphere.

It is sufficient, however, that the reduction be concentrated at the metal-to-metal contact points between the particles in the green compact and this can be promoted by utilizing an organic powder which, containing carbon, promotes reduction or contributes to the reducing action.

When, according to the invention, a partly reduced metal powder is used, neither the body sintered from the green compact nor the compacted or otherwise shaped product have their physical characteristics affected by a residual oxygen contact. Any residual oxygen content is found to be totally ineffective and for example does not have any deleterious effect on the subsequent compaction shape.

Another important advantage of the present invention is that intricate shapes can be fabricated with portions of different cross section without any transfer material between this section during the sintering operation.

The method of the present invention can be carried out with a binder from a starting powder which can be introduced into the compact-shaping form and subjected, prior to introduction into this form, to a physical and/or chemical binder-promoting treatment.

For example with a reduced metal powder, the binder promoting treatment is an oxidation which forms an oxide film on the particles which acts as the binder upon fusion (intermelting) of the oxide films and the metals of mutually contacting particles during the sintering operation.

The process of the invention can utilize practically any metallic particulate material with a minimum of preparation of the powder charge. It suffices, for example to recover the powder by sifting after separation of particles having a size of 600 microns and more. The remainder of the powdered charge, including oxidic dust from the dust removal or air cleaning facility can be used for producing sintered objects.

It is also possible to mix the starting powder from a collection of alloying elements in the form of metal powder, prealloying powders or metal compounds such as oxides, sulfides and carbonates and natural minerals. Even dust, slurries and other metallurgical wastes, to the extent that they consist predominantly of metal, can be used either along or as admixtures to the aforementioned powders. The term "metallic powder" as used herein is intended to comprehend all of these starting materials.

Utilizing the technique of the present invention, a green compact is produced which has the desired quantity of powder in each element of volume and uniformly through any cross section. The compact form can be of simple construction since its filling does not require elevated pressures and the form need not be of the supportable type constituted by a ram and by segments.

Nevertheless the sintered body has a sufficiently high density strength that even with further compression thereof material transfer from one portion of the cross section to another can be avoided without difficulty.

The compaction of the sintered body to the ultimate sintered object can be effected by either hot or cold compression as already indicated and it has been found to be particularly advantageous to utilize a cold compaction step.

For example, the sintered body can be subjected to cold pressing in one or more steps. If desired, the so-called coaxial compaction technique can be used, this being conventional in powder metallurgy and involving the application of pressure. A material flow perpendicular to the present direction is practically nonexistent when sintered bodies made by the present method are used.

It is also possible to employ conventional isostatic presses whereby the sintered body is subjected to pressure while surrounded or closed, in whole or in part, by elastomeric tools. The after-compaction at elevated temperature can utilize a closed tool so that deterioration at two gaps does not occur.

The machines which are employed in accordance with the invention are machines of the type known in the foundry arts as core-forming machines. Reference may be made to pages 1059 ff. of The Making, Shaping and Treating of Steel, United States Steel Company, Pittsburgh, Pa., 1971. Preferably core blowing machines or core-sand slinging machines are employed.

In a core blowing machine, the filling of the so-called core sleeve, which shapes the green compact according to the invention when particulate metals are substituted for the sand and the compaction of the mixture of the particles with the foundry sand binder, is effected by forming a compressed air-sand mixture.

The core sleeve with the intake opening turned upwardly is fixed by mechanical or pneumatically actuated clamping means to a table. By the lifting of the work table via a fluid-operated cylinder in the machine stand, the sleeve is pressed against the nozzle plate which is formed on the bottom of the sand vessel and has one or more orifices.

Compressed air at 5 to 7 bar pressure is introduced laterally into the sand vessel and an agitator is provided to form the compressed air/sand mixture. In the ideal case each individual particle of the sand is surrounded by compressed air.

At the blowing instant the compressed air entrains the sand through the orifices into the sleeve where the sand is compacted under its kinetic energy and the compressed-air force. During the blowing process the compressed air is driven from the sleeve as it is filled with the sand and special venting openings and passages are provided for this purpose.

When a machine of this type is used in the context of the invention, the compact form is substituted for the core sleeve or the core sleeve is constituted as the form in which the compact is shaped and the mixture of foundry sand and synthetic resin binder is replaced by the metal powder or the mixture thereof with the binder.

A core-sand slinging machine is similar in its basic elements to the core blowing machine in that it also has a machine stand, a cylinder elevatable table, a nozzle plate and a sand supply vessel.

The filling of the core sleeve (as in the case of the present invention, of the compact form) and the compression of the particular mass is effected by feeding a predetermined quantity of compressed air with a nominal pressure of 6–8 bars into the sand filled slotted cylinder the mixture expanding therein and acting explosively and in shot-like manner upon the sand column. The sand, driven at a high velocity, enters the sleeve or form between the machine table and the nozzle plate and is effectively fired into the latter.

When such a machine is used in the system of the invention, green compact has high strength and the compact form need not be maintained under the compressed air pressure. Surplus air is discharged through the slotted cylinder where it loosens the remaining sand column without an agitator and is vented through a vave. Special venting openings and passages can be eliminated provided an upward release of the air is possible.

This machine as well can be used with the metal powders of the present invention. Such machines are known in the art and a more detailed description of them is not considered to be necessary.

BRIEF DESCRIPTION OF THE INVENTION

The above and other objects, features and advantages of the present invention will become more readily apparent from the following description reference being made to the accompanying drawing in which the sole FIGURE is a flow diagram illustrating the principles of the present invention.

SPECIFIC DESCRIPTION

A metallic powder, generally a prereduced ferrous metal powder containing a small proportion of copper powder, all of a particle size below about 600 microns, is fed at 1 to any powder preparation or mixing stage 3 which may be desired when the powder is intimately blended with about 1% by weight and a phenolic resin binder supplied at 2 and formed by any conventional foundry sand phenolic binder.

The flowable blended mixture, for which the metal particles may have been subjected to an oxidation treatment as represented at 6 with the oxidized particles supplied at 5, is introduced into a conventional core blowing or core-sand slinging machine 7 in which the green compact is produced in the manner described.

The green compact, completely homogenous in density and can be self-supporting, is removed from the compact form and delivered at 8 to a sintering station 12 which may be supplied with a reducing gas 9 so that reduction can be effected.

The sintered body at 11 is subjected to further densification, i.e. compaction by forging or pressing at 13 the resulting powder metallurgical product 14 being utilizable directly if desired.

It has also been found to be advantageous to subject the further compacted product 15 to a resintering stage 16 and then if desired to final shaping under pressure, the latter being effected in a calibration stage 18 to which the sintered product is delivered at 17. The final powder metallurgical product can be recovered at 19.

SPECIFIC EXAMPLES

EXAMPLES 1

A piston rod or the piston of a passenger vehicle shock absorber is formed as a sintered product. The green compacts are formed from a mixture of pig iron powder with 2% by weight copper powder and 1% by weight phenolic resin. The green compact is shaped in a cross-sand slinging machine of the aforedescribed type with the density of the green compact varied in the axial direction in accordance with the density desired of the valve member. The green compact is then sintered at 950° C. for one hour in an ammonia cracking gas as a reducing atmosphere. The oxide free sintered body is then pressed to a density of 6.8 g/cm$^3$ in a hydraulic press concurrently with the formation of an annular groove for receiving a sealing ring. To this end an additional profile is applied in the pressed direction.

The pressed product is then sintered at 1120° C. in a belt furnace and then calibrated to yield the finished product. A strength test shows the ability to take loads of 250 kN.

EXAMPLE 2

A shock ring for a truck rear axle is fabricated by the method of the invention from pig iron powder with 15% grey cast iron powder, 2% copper powder and 1% phenolic resin (all percentages by weight). The machine used was a core blowing machine and upon removal of the green compact at a density of 3.8 g/cm$^3$ it is sintered at 950° C. for one hour in an ammoniac cracking gas serving as a reducing atmosphere. The carbon content after reduction was 0.6%. The sintered compact was densified in a hydraulic press to a density of 7.0 g/cm$^3$ and was found to have an extremely homogenous density distribution. The densified sintered product was then resintered at 1120° C. in a belt furnace and calibrated. The finished product was found to have a perlitic structure and a Brinell hardness of HB 160.

EXAMPLE 3

A journal bearing with a flange is formed in a core-sand slinging machine from a carbon free iron powder containing 1% phenolic resin. The green compact was heated at 950° C. in ammonia cracking gas and the sintered product was pressed by an appropriately shaped tool so that the shaft disk was 6.5 g/cm$^3$.

The densified product was sintered in a walking beam furnace at 1280° C. using conventional techniques. The Brinell hardness of the sleeve was about HB 45 while that of the flange was HB 66.

EXAMPLE 4

A thread guide for a spinning machine was produced by sintering in accordance with the invention. The thread guide had a configuration approximating a cylinder with a more or less helical groove. Conventional powder metallurgical methods could not be used because of the shape.

For the inner contour of this object, a sand core was first made by conventional foundry methods and was then surrounded in a core slinging machine with a mixture of pig iron powder containing 25% by weight grey cost iron powder and 1% by weight phenolic resin. The outer contour corresponded to the outer shape desired.

The green compact was subject to 950° C. for one hour ammonia cracking gas as a reducing atmosphere, this sintering operation displaying the integrity of sand core so that it could be removed. The sintered body was then inserted into separable steel pattern covered with a silicon film and of a shape complementary to the outer contour. The body was then subjected to isostatic compression such that the pressure was applied only along the interior of the ring. The outer contour had the precise shape desired. The density of the product after application of a pressure of 6000 bar was about 7.2 g/cm$^3$. The body was then resintered in a crucible furnace at 1200° C. The product has the desired ferritic-perlitic structure.

I claim:

1. A method of making a powder metallurgical product of high homogeneity and reproducibility which comprises the steps of:

(a) forming a green compact of substantially the shape of said product by entraining a powder metallurgical mass consisting predominantly of particles of a metallic material and between about 1% to about 10% by weight of an organic binder in compressed air, and directing the compressed air entrained mass into a shaping sleeve thereby compacting said mass with high kinetic energy into a compact form in a foundry type core forming machine with particles in metal-to-metal contact held together by said binder in a coherent body;

(b) removing said green compact from said form; and (c) sintering the green compact removed from said form outside of any containment.

2. The method defined in claim 1 wherein said binder is present in an amount of about 1% by weight of said mass.

3. The method defined in claim 1 wherein said mass consists predominantly of unreduced metal particles, the sintering in step (c) being effected in a reducing atmosphere.

4. The method defined in claim 1, further comprising the step of (d) densifying the sintered body resulting from step (c).

5. The method defined in claim 4, further comprising the step of (e) sintering the densified body resulting from step (d).

6. The method defined in claim 5, further comprising subjecting the metallic powder of said mass to a physical and/or chemical treatment at least prior to removal of said green compact from said form.

7. The method defined in claim 6 wherein said treatment is an oxidation.

8. A method of operating a foundry type core forming machine which comprises the steps of feeding a mass consisting predominantly of metal particles and between about 1% to about 10% by weight of a phenolic resin foundry sand binder to said machine and entraining said mass by compressed air in said machine to form a green compact of said material therein whereby said compact can be sintered outside said form.

* * * * *